US005322277A

United States Patent [19]

Paul et al.

[11] Patent Number: 5,322,277

[45] Date of Patent: Jun. 21, 1994

[54] FENCING BLADE

[75] Inventors: Barry R. Paul; Raymond Paul, both of London, England

[73] Assignee: Leon Paul Equipment Company Limited, London, England

[21] Appl. No.: 18,248

[22] Filed: Feb. 16, 1993

[30] Foreign Application Priority Data

Feb. 13, 1992 [GB] United Kingdom ..... 9203025
Jul. 3, 1992 [GB] United Kingdom ..... 9214144

[51] Int. Cl.[5] ..... A63B 69/02; F41B 13/02

[52] U.S. Cl. ..... 273/57.3; 72/362; 30/346; 30/356; 482/12

[58] Field of Search ..... 273/57.3; 482/12; 30/346, 349, 351, 353, 356; 29/17.1; 72/362

[56] References Cited

U.S. PATENT DOCUMENTS 2,294,026 8/1942 Tuscan ..... 273/57.3 X
4,752,076 6/1988 Gelinas, Jr. ..... 273/318
4,817,942 4/1989 Begon ..... 482/12
4,890,390 1/1990 Begon ..... 30/346

FOREIGN PATENT DOCUMENTS 2515332 4/1983 France .
2649476 1/1991 France .
WO86/06824 11/1986 PCT Int'l Appl. .
2129315 5/1984 United Kingdom ..... 482/12
2191709 6/1985 United Kingdom .

*Primary Examiner*—William H. Grieb
*Attorney, Agent, or Firm*—Dennison, Meserole, Pollack & Scheiner

[57] ABSTRACT

A fencing blade is described comprising a substantially planar elongate strip having at least a portion thereof shaped to be non-planar in cross-section. In a preferred embodiment of the invention, a foil or sabre type blade is made from a planar, tapering, elongate steel billet pressed into a 'U' or 'V' shape along substantially two thirds of its length, the remaining one third of the blade being left flat. The blade may be formed of separate tang/shoulder and blade sections, which may be releaseably or permanently connected together.

6 Claims, 3 Drawing Sheets

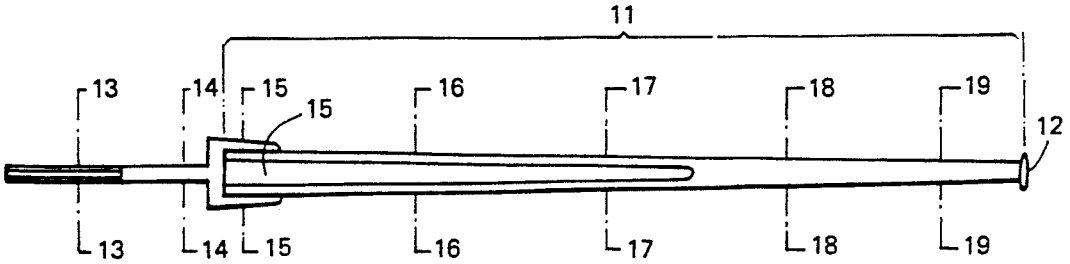
FIG. 11
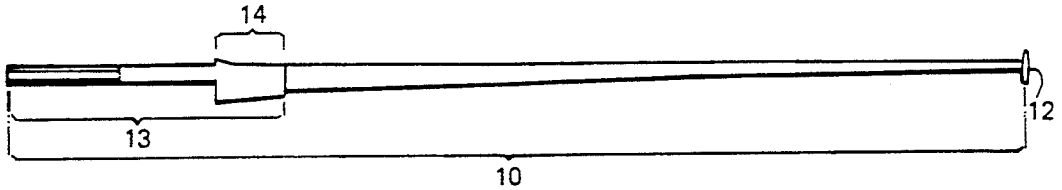
FIG. 12
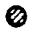
FIG. 13
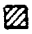
FIG. 14
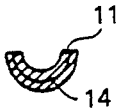
FIG. 15
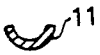
FIG. 16
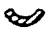
FIG. 17
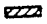
FIG. 18
FIG. 19

FENCING BLADE

BACKGROUND OF THE INVENTION

The present invention relates to the field of fencing blades, and in particular to improvements in blades used in the sport of fencing.

Prior art fencing blades are forged down from a single piece large diameter billet and are manufactured to ensure a degree of stiffness along their length between predetermined minimum and maximum limits.

A typical prior art fencing blade used in the sport of fencing has a handle end (the tang) formed into a 6 mm diameter round section followed by a short square section approximately 6.25 mm×6.25 mm. The tang is machined to take a hand guard, a handle and a nut or pommel that holds these parts onto the tang. The square part of the tang is formed to become a shoulder against which the guard is locked. The shoulder region is approximately 100 $mm^2$ in square cross-section nearest the tang and, over a distance of generally between 30 and 100 mm, tapers down to a cross-sectional area of approximately 36 $mm^2$. Then begins the working part of the blade, which tapers down to the tip to a cross-sectional area of between 7 $mm^2$ and 12 $mm^2$. This basic layout is common to all three types of blades presently used for fencing, namely épées, foils and sabres. Terms commonly used to identify areas of the blade are, starting from the handle end, Tang (soie), Shoulder (talon), Strong (forte) , Middle (moyenne) , Weak (foible) and Tip (point) .

As mentioned above, prior art fencing blades are made from single piece billets which are machined or worked to provide tang, shoulder and working part. However, even starting from a tapered billet, considerable wastage may occur in shaping the blade such that the cross-sectional area along the length of the blade reduces from shoulder to tip at the required rate and is of the required form. The different types of prior art blade each have a different cross-sectional form. The prior art method of manufacture is both time-consuming and requiring of skilled workmanship. Thus, prior art blades are relatively expensive to produce.

SUMMARY OF THE INVENTION

It is therefore desired to provide an improved design of blade being both quick and easy to manufacture. Further, a blade having similar characteristics to prior art blades in respect of meeting all of the imposed rigidity requirements is sought.

According to the present invention there is provided a blade, particularly for fencing, comprising a substantially planar elongate strip having at least a portion thereof shaped to be non-planar in crosssection.

Calculation and experimentation has shown that, surprisingly, a blade can be made from a substantially flat or planar blank bent along part, parts or all of its length, thereby increasing the rigidity of at least a portion of the blade compared with its flat (unformed) state. In particular, a fencing blade may be made which satisfies all of the technical requirements, regarding length, weight, rigidity and the like, from time to time in force in respect of blades used in the sport of fencing. Factors affecting the characteristics of a blade are the thickness of the blank, the material used, the width and the amount and shape of deformation.

In the simplest, preferred, form of the invention, the blank is of substantially constant thickness. The blank may be cut from a flat or planar sheet or strip of suitable material or made by any other suitable technique. The thickness of the blank remains substantially constant after shaping, but the profile of the blank or blade is altered to increase rigidity over a selected portion thereof.

A blade according to this invention has many advantages. Firstly, the blade is easier and less expensive to manufacture than those of the prior art, and with less wastage. Secondly, the blade is lighter. Thirdly, the blade is less stressed for a given bend than a prior art type blade, thus lasting longer before failure. Other advantages of the present invention will become apparent from the remaining description.

Preferably, the flat blank is shaped, for example by being forged, pressed into a mould or other suitable technique, such that at least a portion thereof is curved, 'V '-shaped, 'U'—shaped, dished, ridged or angled in cross-section, or any other suitable shape. In particular, a simple 'U' or 'V' shape along some or all of the blade, preferably becoming gradually less pronounced from the handle end of the blade to towards the tip end, produces a satisfactory blade. The shaping may be constant over a particular portion or may vary according to design along the length of the blade. Complicated geometries may be used but such tend to be more difficult to design and form.

In a first particular embodiment, an entire blade is made from a single substantially planar blank, wherein the tang and shoulder region are formed by folding and pressing a portion of the blank and the working part of the blade is shaped to have at least one non-planar section.

In a second embodiment, a complete blade is formed from two separately manufactured parts. A tang, shoulder and shoulder region ( forte ) are formed, for example by casting or drop forging and subsequent machining, as one section. The shoulder region (forte) is designed to receive a separately manufactured blade portion formed by shaping a flat blank. The joint may be readily separable to allow an alternative or replacement blade to be fitted to the shoulder region, for example using screws or a nut and bolt arrangement, or may be permanent, for example by braising, welding or gluing.

Preferably, a blank having linearly tapering sides is used. However, a blank with curved or non-linear edges may equally be used. The advantage of non-linearly tapering edges being that the change in the degree of flexibility of the blade along its length may vary nonlinearly and thus, if desired, allow greater design freedom in producing a blade with desired characteristics. Such a non-linearly tapering blank is formed by, for example, punching or laser cutting a blank from a flat sheet.

A variety of materials may be used to form a suitable blade. In addition to conventional carbon steels, a blade may be made from Maraging steel, composite steel such as Paul steel, or any other suitable material, including plastics material or composite sheet. A suitable composite sheet consists of two metal outer layers of, for example, Maraging steel, aluminium or titanium, and a central layer of a plastics material, for example a prepregnated plastic fibre such as carbon fibre. After cutting and forming, the composite may be finished by heat setting the plastics material layer if required, or by leaving such to cure.

It is further possible to adapt a blade according to the present invention for use as an 'electric' blade, by attachment of a wire or wires to the working part of the blade. A gap is left between the tang and the working part of the blade such that the wire or wires can be brought out at the tang.

BRIEF DESCRIPTION OF THE DRAWINGS

FIG. 11 is a plan view of a blade in accordance with a preferred embodiment of the present invention;
FIG. 12 is a side view of the blade of FIG. 11;
FIG. 13 is a cross-section on line 13—13 of FIG. 11;
FIG. 14 is a cross-section on line 14—14 of FIG. 11;
FIG. 15 is a cross-section on line 15—15 of FIG. 11;
FIG. 16 is a cross-section on line 16—16 of FIG. 11;
FIG. 17 is a cross-section on line 17—17 of FIG. 11;
FIG. 18 is a cross-section on line 18—18 of FIG. 11;
FIG. 19 is a cross-section on line 19—19 of FIG. 11.

DETAILED DESCRIPTION OF THE INVENTION

Figure 1:
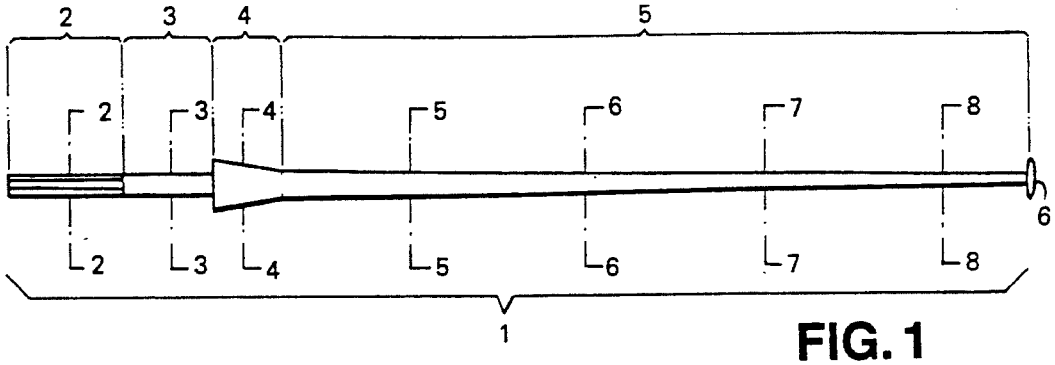
FIG. 1 PRIOR ART
FIG. 1 is a plan view of a prior art blade.
Figure 2:
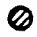
FIG. 2 is a cross-section on line 2—2 of FIG. 1.
Figure 3:
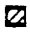
FIG. 3 is a cross-section on line 3—3 of FIG. 1.
Figure 4:
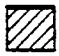
FIG. 4 is a cross-section on line 4—4 of FIG. 1.
Figure 5:
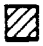
FIG. 5 is a cross-section on line 5—5 of FIG. 1.
Figure 6:
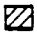
FIG. 6 is a cross-section on line 6—6 of FIG. 1.
Figure 7:
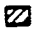
FIG. 7 is a cross-section on line 7—7 of FIG 1.
Figure 8:
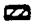
FIG. 8 PRIOR ART
FIG. 8 is a cross-section on line 8—8 of FIG. 1.

With reference to FIGS. 1-8 of the drawings, a prior art fencing blade 1 is shown, this blade being forged in the traditional manner from a single billet to form the tang 2, shoulder 3, shoulder region (forte) 4, working part of the blade 5 and tip portion 6.

With reference to FIGS. 9-26 of the drawings, it can be seen that the preferred embodiments of the present invention differ significantly from the prior art type blade.

Figure 9:
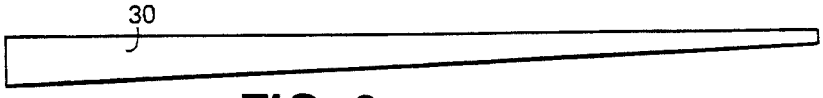
FIG. 9 is a plan view of an unformed blank used in a preferred embodiment of the present invention.
Figure 10:
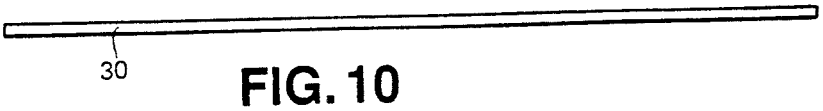
FIG. 10 is a side view of the blank of FIG. 9.
Figure 20:
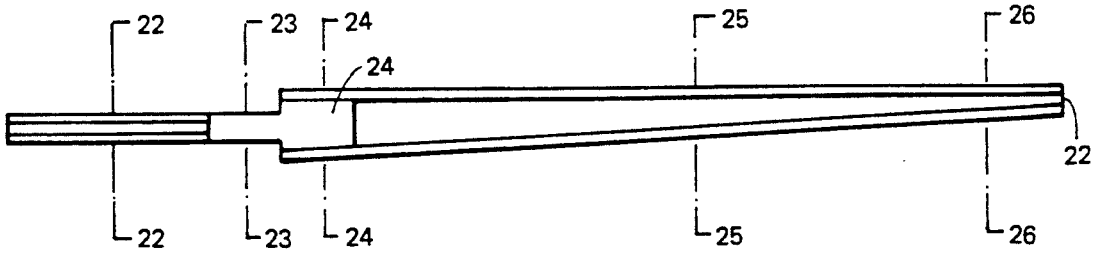
FIG. 20 is a plan view of an alternate preferred embodiment of the present invention.
Figure 21:
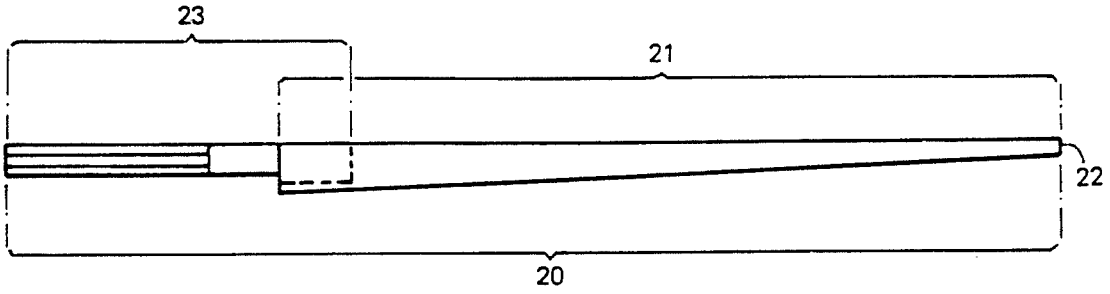
FIG. 21 is a side view of the blade of FIG. 20.
Figure 22:
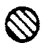
FIG. 22 is a cross-section on line 22—22 of FIG. 20.
Figure 23:
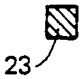
FIG. 23 is a cross-section on line 23—23 of FIG. 20.
Figure 24:
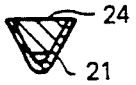
FIG. 24 is a cross-section on line 24—24 of FIG. 20.
Figure 25:
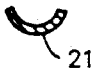
FIG. 25 is a cross-section on line 25—25 of FIG. 20.
Figure 26:
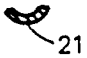
FIG. 26 is a cross-section on line 26—26 of FIG. 20.

A plan and side view of a suitably profiled blank 30 as may be used in the preferred embodiments of the present invention is shown in FIGS. 9 and 10 of the drawings. This blank is cut on a guillotine from a constant thickness sheet.

Referring now to FIGS. 11-19 of the drawings, a blade 10 having characteristics similar to prior art types known as 'Sabre' and 'Foil' blades is shown. The working portion 11 of the blade 10 is formed from a linearly tapered blank of the type shown in FIGS. 9 and 10. The blank is cut from 2.3 mm sheet maraging steel such as RVRH 32 grade. Alternatively, carbon steel such as EN45, EN47 or EN19 grade may be used. The blank is 850 mm long, 4.2 mm by 2.3 mm at one end and 12 mm by 2.3 mm at the other end.

The blank is forged or pressed until the first approximately 630 mm, i.e. the first two thirds starting at the widest end, is shaped into a shallow 'U'-shape. The radius of curvature at the widest end 15 is approximately 2 mm and becomes progressively less pronounced down to about 1.5 mm two thirds of the way along the blank. The remaining third of the blank, about 230 mm, is left flat and unformed. The tip 12 is blunted, and the working part 11 fixed by its widest (handle) end 15 to the shoulder region 14 of a separate tang, shoulder and shoulder region section 13 by braising. In this embodiment, the working part 11 is fitted into the cupped shoulder region 14. A guard, handle grip, and pommel (not shown) may be fitted in order to form a complete weapon.

A blade 20 having similar characteristics to a prior art épée type blade is shown in FIGS. 20-26. The working part 21 of the blade 20 is made by shaping substantially the entire length of a linearly tapering blank into a shallow 'U' or 'V'-shape.

The requirements for an épée type blade are best achieved by using a starting blank between 1.2 mm and 1.4 mm thick, tapering from substantially 20 min in width at one end to 6.5 mm at the other. The blank used is substantially as the blank 30 shown in FIGS. 9 and 10. The best material is again maraging steel such as RVRH 32 grade, though carbon steels may be used. The blank is shaped to have a cross-sectional radius of curvature of substantially 1.5 mm toward the tip end 22, e.g. cross sections 25-25 and 26—26 of FIG. 22-26 becoming more 'V'-shaped where the working part 21 and the shoulder region 24 of the blade are joined at 24—24.

In this embodiment, the working part 21 of the blade fits over the shoulder region 24. The separate tang, shoulder and shoulder region 23 is drop forged or cast and machined. For a permanent joint, the two parts are braised together. For a releaseable joint, a hole (not shown) is drilled through the working part and the shoulder region, for example at 24—24 , and a nut and bolt arrangement (not shown) used to secure these two parts together.

We claim:

1. A fencing blade comprising a substantially planar elongate strip tapering in width along its substantive length, said strip having at least a portion of its length bent over and forming a substantially V-shaped or U-shaped cross-section along said portion, said strip having a wall thickness which is substantially uniform along the length thereof, including along said bent portion.

2. A blade as claimed in claim 1, wherein the elongate strip is shaped to be substantially V-shaped or U-shaped in crosssection along substantially its entire length.

3. A blade as claimed in claim 1, wherein said bent cross-section extends to one end of said elongate strip, said blade further comprising a separate tang and shoulder region, and wherein the shoulder region has a shape complementary to said bent cross-section of said strip at said one end to securably receive said one end of the elongate strip.

4. A blade as claimed in claim 3, further comprising securing means for releasably securing the elongate strip to the shoulder region.

5. A blade as claimed in claim 4, wherein the elongate strip is shaped to be substantially V-shaped or U-shaped in cross-section along substantially two thirds of its length.

6. A fencing blade comprising two main parts in which an integral tang and shoulder region is one part and a blade formed from a billet. comprising an elongate tapered strip cut from a sheet of constant thickness is the other part, said strip being shaped to a substantially V-shaped or U-shaped cross section for at least a portion of its working length, the wall thickness of said strip being substantially uniform along its entire length including said portion of substantially V-shaped or U-shaped cross-section.

* * * * *